United States Patent [19]

Hougård

[11] Patent Number: 5,044,119

[45] Date of Patent: Sep. 3, 1991

[54] FLOWERPOT BOWL

[76] Inventor: Erling Hougård, 4, Sportsvej, Jyllinge, Denmark 4040

[21] Appl. No.: 368,396

[22] PCT Filed: Sep. 21, 1987

[86] PCT No.: PCT/DK87/00115

§ 371 Date: May 18, 1989

§ 102(e) Date: May 18, 1989

[51] Int. Cl.[5] ..... A01G 9/02

[52] U.S. Cl. ..... 47/66; 47/71; 47/80

[58] Field of Search ..... 47/71, 79, 66, 80, 81

[56] References Cited

U.S. PATENT DOCUMENTS

| | | | |
|---|---|---|---|
| 19,406 | 11/1889 | Whilldin . | |
| 20,055 | 7/1890 | Whilldin . | |
| 20,336 | 11/1890 | Whilldin . | |
| 1,391,353 | 9/1921 | Wells . | |
| 1,775,831 | 2/1927 | Salisbury . | |
| 2,770,957 | 11/1956 | Bronson | 47/71 X |
| 2,810,234 | 10/1957 | Blackburn . | |
| 2,863,259 | 12/1958 | Radford . | |
| 3,053,010 | 9/1962 | De Shazor . | |
| 3,079,037 | 2/1963 | Schechter | 47/71 X |
| 3,315,410 | 4/1967 | French . | |
| 3,381,410 | 5/1968 | Potain | 47/71 X |
| 3,758,987 | 9/1973 | Crane, Jr. | 47/80 |
| 3,775,904 | 12/1973 | Peters | 47/80 |
| 3,800,469 | 4/1974 | Lau, Jr. et al. . | |
| 4,083,147 | 4/1978 | Garrick | 47/80 |
| 4,161,844 | 7/1979 | Hentschel et al. . | |
| 4,171,593 | 10/1979 | Bigglestone . | |
| 4,173,097 | 11/1979 | Staby . | |
| 4,329,815 | 5/1982 | Secrest | 47/80 |
| 4,735,016 | 4/1988 | Hougard . | |

FOREIGN PATENT DOCUMENTS

| | | | |
|---|---|---|---|
| 181992 | 5/1955 | Austria | 47/66 |
| 184399 | 5/1955 | Austria | 47/79 |
| 1712687 | 12/1955 | Fed. Rep. of Germany . | |
| 1836786 | 8/1961 | Fed. Rep. of Germany . | |
| 1582683 | 9/1970 | Fed. Rep. of Germany . | |
| 7220959 | 6/1972 | Fed. Rep. of Germany . | |
| 1507005 | 10/1974 | Fed. Rep. of Germany . | |
| 3119778 | 12/1982 | Fed. Rep. of Germany . | |
| 3490714 | 11/1988 | Fed. Rep. of Germany . | |
| 1470367 | 2/1967 | France | 47/79 |
| 8105726 | 7/1983 | Netherlands . | |
| 60986 | 6/1937 | Norway . | |
| 77113 | 7/1950 | Norway . | |
| 128773 | 7/1950 | Sweden . | |
| 52220 | 10/1910 | Switzerland | 47/71 |
| 277547 | 12/1951 | Switzerland . | |
| 15061 | 7/1901 | United Kingdom . | |
| 103027 | 1/1917 | United Kingdom . | |
| 659846 | 10/1951 | United Kingdom . | |
| 1069101 | 5/1967 | United Kingdom . | |
| 1442026 | 7/1976 | United Kingdom | 47/71 |
| 1516384 | 5/1978 | United Kingdom . | |
| 2018115 | 10/1979 | United Kingdom . | |
| 2098044 | 11/1982 | United Kingdom . | |

*Primary Examiner*—Richard E. Chilcot, Jr.
*Assistant Examiner*—Joanne C. Downs
*Attorney, Agent, or Firm*—Pennie & Edmonds

[57] ABSTRACT

A flowerpot bowl consists of a closed bottom (12) and an encircling closed side wall (14) connected with it which at least in its upper part has a plane inner side (16) extending in the axial direction and at the same time, the bottom (12) is shaped with at leasat one sunk part (18) being in open communication with the intervening space (26) defined by the side wall (14) of the pot bowl and the flowerpot inserted in the pot bowl.

8 Claims, 1 Drawing Sheet

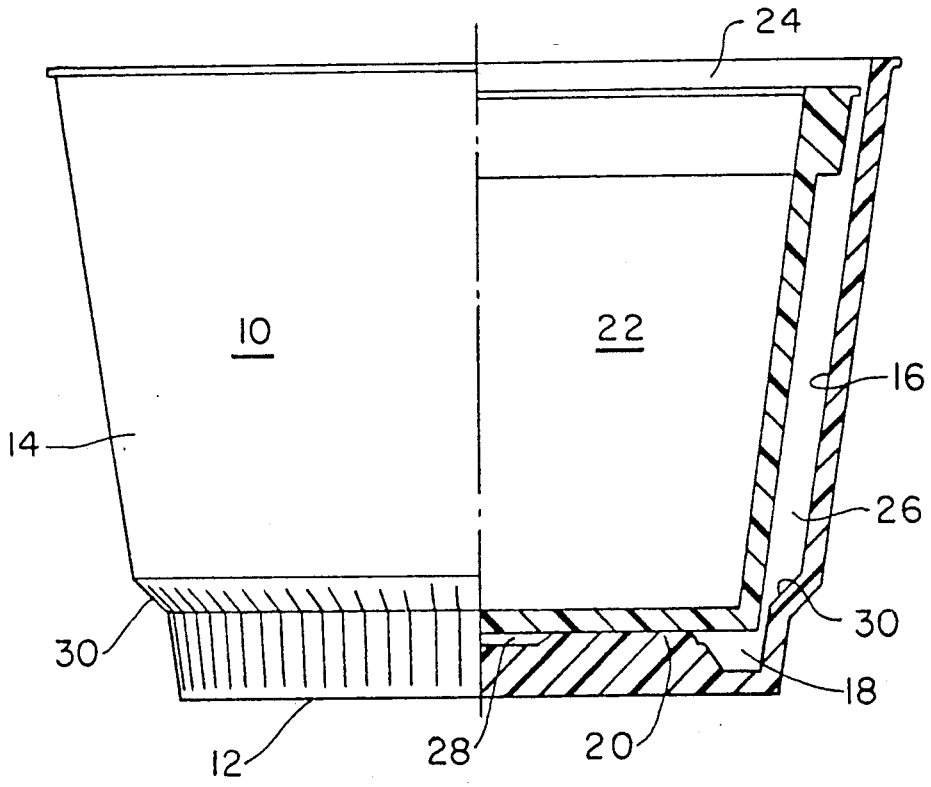
24
10
22
16
14
26
30
30
18
12
28
20

FLOWERPOT BOWL

TECHNICAL FIELD

The invention concerns a flowerpot bowl consisting of a closed bottom and an encircling closed side wall connected with it.

SUMMARY OF THE INVENTION

It is the object of the invention to provide a flowerpot bowl which beyond having an attractive look is adapted to provide optimum growing conditions for the pot plant placed in the pot bowl.

According to the invention this is achieved by the fact that the side wall, at least in its upper part, has a plane inner side extending in the axial direction and at the same time that the bottom is provided with at least one sunk part being in open communication with the intervening space defined by the side wall of the pot bowl and a flowerpot inserted in the pot bowl.

Intervening spaces which are accessible from above are formed around the side wall of the flowerpot as well as under its bottom allowing water to be delivered to or conducted away from the openings with which the bottom of the pot is normally provided. Similarly, these spaces allow ventilating air to get access to these openings. As a flowerpot bowl—for serving its aesthetic purpose—is normally higher than the flowerpot it is defined to receive, any potential excess water from top watering does not overflow (e.g., onto a window sill), but runs down into the pot bowl where it either is absorbed by the pot filling or evaporates through the intervening space between the side walls of the pot bowl and the flowerpot. If the mentioned intervening space is kept free of water, the pot filling is ventilated from beneath via the intervening space.

According to the invention said sunk part can be shaped like a groove in the bottom of the pot bowl extending along rim portions of the bottom of the pot bowl so that water running down from above is collected without spreading under the bottom of the flowerpot. According to the invention, the sunk part may also been obtained by means of at least one spacing rib projecting from the closed bottom of the pot bowl somewhat up into the pot bowl. Thus, the bottom of a flowerpot inserted into the pot bowl is kept free of the closed bottom of the pot bowl. This is of special advantage to the ventilating effect.

BRIEF DESCRIPTION OF THE DRAWINGS

The invention will be described in the following with reference to the drawing showing schematically an embodiment of the flowerpot bowl seen partly from the side and partly in axial section.

DETAILED DESCRIPTION OF THE INVENTION

A flowerpot bowl 10 consists of a closed bottom 12 and an encircling closed side wall 14 connected with it. On the inner side, said side wall 14 at least in its upper part is provided with a plane inner side 16 extending in the axial direction and which, in the present embodiment, is completely smooth. The bottom 12 of the pot bowl is shaped partly with an annular groove 18 extending along the rim portion of the bottom and partly with ribs 20 projecting from the closed bottom somewhat up into the pot bowl.

A flowerpot 22 has an encircling rim edge 24 projecting in the transverse direction. Although the flowerpot inserted into the pot bowl with this rim edge 24 is abutting on the side wall portion 16, the remaining part of the flowerpot 22 is kept free of the side wall of the flowerpot bowl 10. Therefore, a flowerpot 22 inserted in the flowerpot bowl 10 together with the side wall and the bottom of the flowerpot will form partly an encircling side space 26 and partly a lower space 28 extending beneath the bottom of the pot and brought about by the elements 18 and 20. The spaces 26 and 28 are in open communication with each other.

In the shown embodiment, the side wall 14 of the flowerpot bowl has an increased diameter above the groove 18 formed by a graduated stepping 30, so that the chamber is of a suitable size to collect the excess water from top watering which gathers in the groove 18 and space 28. Chamber 26 may also serve in the ventilation of the pot filling through the openings normally placed in the bottom of the flowerpot. As shown in the drawing, the side wall of the flowerpot bowl exceeds the side wall of the flowerpot to the extent that the upper edge of the latter is hidden.

I claim:

1. A flowerpot bowl (10) for use with a separate flowerpot, consisting of a closed bottom (12), an open top and an encircling closed side wall (14) connected with the bottom and extending to the open top, said side wall (14) at least in its upper part having a plane inner side extending in an axial direction, said bottom (12) being provided with at least one sunk part, which is in open communication with an intervening space defined by the side wall (14) of the flowerpot bowl (10) and a flowerpot (22) inserted in the flowerpot bowl (10), characterized in that the sunk part is shaped like a circumferential annular groove (18) in said bottom (12) extending along a perimetric portion of said bottom, said side wall (14) at its lower end having a decreased diameter starting at a distance substantially above said bottom, and downwardly defining an outer wall of said circumferential groove (18), so that said groove is capable of being substantially positioned below the bottom of a flowerpot (22), inserted in the flowerpot bowl (10) said decreased diameter being formed by a graduated stepping (30) of said side wall (14).

2. In a combination of a removable flowerpot (22) and a flowerpot bowl (10), wherein the flowerpot bowl consists of a closed bottom (12), an open top and an encircling closed side wall (14) connected with the bottom and extending to the open top, said side wall (14) at least in its upper part having a plane inner side extending in an axial direction, said bottom (12) being provided with at least one sunk part, which is in open communication with an intervening space defined by the side wall (14) of the flowerpot bowl (10) and a removable flowerpot (22) inserted in the flowerpot bowl (10), and seated on said bottom the improvement wherein:

the sunk part is shaped like a circumferential annular groove (18) in said bottom (12) extending along a perimetric portion of said bottom, said side wall (14) at its lower end having a decreased diameter starting at a distance substantially above said bottom, and downwardly defining an outer wall of said circumferential groove (18), so that said groove will be substantially positioned below the bottom of said flowerpot (22) inserted in the flowerpot bowl (10), said decreased diameter being formed by a graduated stepping (30) of said side wall (14).

3. A flowerpot bowl according to claim 1 further characterized in that:

a) said annular groove (18) has a bottom; and b) the bottom (12) of said flowerpot bowl includes a center part disposed radially inwardly of said annular groove (18), positioned at a height above the bottom of the annular groove and separated from said annular groove by rib means (20) projecting upwardly from the bottom of the flowerpot bowl and into said bowl to a height above said center part.

4. A combination of a removable flowerpot (22) and a flowerpot bowl (10), wherein the flowerpot bowl consists of a closed bottom (12), an open top and an encircling closed side wall (14) connected with the bottom and extending to the open top, said side wall (14) at least in its upper part having a plane inner side extending in an axial direction, said bottom (12) being provided with at least one sunk part, which is in open communication with an intervening space defined by the side wall (14) of the flowerpot bowl (10) and a removable flowerpot (22) inserted in the flowerpot bowl (10), and seated on said bottom characterized in that the sunk part is shaped like a circumferential annular groove (18) in said bottom (12) extending along a perimetric portion of said bottom, said side wall (14) at its lower end having a decreased diameter starting at a distance substantially above said bottom, and downwardly defining an outer wall of said circumferential groove (18), so that said groove will be substantially positioned below the bottom of said flowerpot (22) inserted in the flowerpot bowl (10), said decreased diameter being formed by a graduated stepping (30) of said side wall (14).

5. The combination according to claim 4 further characterized in that:

a) the bottom (12) of said flowerpot bowl includes a center part disposed radially inwardly of said annular groove (18) and separated therefrom by rib means (20) projecting upwardly from said bottom and into said bowl to a height above said center part; and b) said flower pot is seated on said rib means when inserted into said flowerpot bowl to provide a lower space (28) between the bottom of the flowerpot and the center part of said flowerpot bowl.

6. The combination according to claim 5 wherein:

a) said annular groove has a bottom; and b) the center part of the bottom of the flowerpot bowl is at a height above the bottom of the annular groove.

7. The combination according to claim 5 wherein:

a) said intervening space defined by the side wall of the flowerpot bowl and the flowerpot and the lower space defined by the bottom of the flowerpot and the center part of the flowerpot bowl are in communication with each other; and b) the bottom of the flowerpot includes a hole overlying the center part of the bottom of the flowerpot bowl placing the interior of the flowerpot in communication with said lower space.

8. The combination according to claim 7 wherein:

a) the rib means includes a plurality of ribs.

* * * * *